US008424876B2

(12) United States Patent
Hutchinson et al.

(10) Patent No.: US 8,424,876 B2
(45) Date of Patent: Apr. 23, 2013

(54) REACTIVE FIREARM TRAINING TARGET

(75) Inventors: Anna Hutchinson, Woodlawn (CA); Tim Beckwith, Ottawa (CA); Jeff Rocque, Carp (CA)

(73) Assignee: R.A.S.R. Thermal Target Systems Inc., Ottawa, Ontario (CA)

( * ) Notice: Subject to any disclaimer, the term of this patent is extended or adjusted under 35 U.S.C. 154(b) by 250 days.

(21) Appl. No.: 12/988,536

(22) PCT Filed: May 5, 2009

(86) PCT No.: PCT/CA2009/000616

§ 371 (c)(1),
(2), (4) Date: Oct. 19, 2010

(87) PCT Pub. No.: WO2009/135302

PCT Pub. Date: Nov. 12, 2009

(65) Prior Publication Data

US 2011/0042900 A1 Feb. 24, 2011

Related U.S. Application Data

(60) Provisional application No. 61/050,433, filed on May 5, 2008.

(51) Int. Cl.
*F41J 2/02* (2006.01)

(52) U.S. Cl.
USPC ..... 273/348.1

(58) Field of Classification Search ..... 273/348.1, 273/378–410
See application file for complete search history.

(56) References Cited

U.S. PATENT DOCUMENTS

| | | | | |
|---|---|---|---|---|
| 2,899,204 | A * | 8/1959 | Ratay | 273/392 |
| 4,240,212 | A | 12/1980 | Marshall | |
| 4,253,670 | A | 3/1981 | Moulton | |
| 4,260,160 | A | 4/1981 | Ejnell | |
| 4,279,599 | A * | 7/1981 | Marshall et al. | 273/348.1 |
| 4,792,142 | A * | 12/1988 | Davies | 273/348.1 |
| 4,946,171 | A * | 8/1990 | Merle et al. | 273/348.1 |
| 5,065,032 | A | 11/1991 | Prosser | |
| 5,865,439 | A * | 2/1999 | Marcuson et al. | 273/406 |
| 5,901,959 | A * | 5/1999 | Tessiot | 273/348.1 |
| 5,924,694 | A * | 7/1999 | Kent | 273/408 |
| 7,377,517 | B2 * | 5/2008 | Andren et al. | 273/348.1 |
| 7,820,969 | B2 * | 10/2010 | Guinn et al. | 250/330 |
| 2009/0194942 | A1 * | 8/2009 | Hodge | 273/348.1 |
| 2011/0175292 | A1 * | 7/2011 | Carni et al. | 273/348.1 |

FOREIGN PATENT DOCUMENTS

| | | |
|---|---|---|
| GB | 2045407 | 10/1980 |
| WO | 2004/099706 | 11/2004 |

* cited by examiner

*Primary Examiner* — Mark Graham
(74) *Attorney, Agent, or Firm* — Borden Ladner Gervais LLP

(57) ABSTRACT

The present invention provides a heatable long range metal target capable of providing acoustic feedback to the user on impact and is durable to withstand the repeated vibration stress that occurs during repeated use. In a preferred embodiment, target includes a reactive target body for generating an audible feedback signal on impact by a firearm round (such as a metal gong), a heating element and a fastening structure connectable to the target body for mounting of the heating element to the target body. The target body has a front, impact surface and a rear surface and is constructed of hardened steel for withstanding repeated impact by high velocity rounds on the impact surface without penetration. The heating element heats a target region of the target and the fastening structure connects the heating element to the target body away from the impact surface. The fastening structure includes a vibration dampening portion.

13 Claims, 5 Drawing Sheets

REACTIVE FIREARM TRAINING TARGET

RELATED APPLICATIONS

This application is a national phase entry application of PCT Application PCT/CA2009/000616, filed May 5, 2009 and entitled Reactive Firearm Training Target, which claims priority from United States Provisional Application SN 61/050,433, filed May 5, 2008 and entitled Reactive Firearm Training Target, the contents of both being incorporated herein in their entirety.

FIELD OF THE INVENTION

The present invention relates generally to targets used in live firearm training. More particularly, the present invention relates to targets used in long range firearm training.

BACKGROUND OF THE INVENTION

Different types of targets are used in target practice. The majority of targets used are penetrated by the shot round, to allow for an indication of the shooter's accuracy. Thermal targets, heated for detection with infrared sighting equipment are known for use in night training. Numerous heated targets are known in the art.

Long range firearm training generally requires specialized targets. Due to the large distance to the target, recovery of the target after a selected number of shots to judge the shooter's accuracy is impractical. Therefore long range targets are normally constructed for re-use. However, due to the high velocity of long range firearm ammunition, long range targets must be constructed of highly robust materials to allow re-use. Therefore, metal targets are used instead of the paper targets normally used in short range training. Moreover, long range metal targets must not only withstand repeated hits, but, more importantly, must be reactive, which means they must provide acoustic feedback to the marksman when hit, since visual observation of the shooter's accuracy is difficult.

Military groups employ long range metal targets made from sheets of R5400 steel or Hardox, generally approximately 1 cm thick. The targets are suspended from A-frames and are used as at-a-distance targets. In long range training, military marksmen are typically at such a distance from the target that visual verification of a hit is difficult and close range inspection of the target too time consuming. In such situations it is vital that the target be of the reactive type, producing an audible signal or acoustic feedback, when hit by a round.

As military technology has progressed, systems have been developed which allow marksmen to aim at a target during the night. They include night vision systems and thermal imaging systems. Night vision systems use image enhancement technology that makes use of lenses to collect small amounts of light, including from the near infrared spectrum, and to amplify and concentrate the light so that it becomes visible to the human eye. This acts to enhance the intensity range of a viewer's vision. When using night vision systems, targets such as R5400 steel blanks are visible due to their difference in reflectivity compared to the background.

Thermal imaging systems on the other hand make use of the fact that warm-blooded creatures have heat signatures (IR signatures) that differentiate them from the heat signature of the background. Thermal imaging systems are sufficiently refined, and sufficiently robust, to be used for in-field training. Target training with thermal imaging systems is however difficult, since targets, especially metal targets, do not generate a heat signature and generally take on the same temperature as their surroundings. Thus, they cannot be easily differentiated from the background. This is especially the case at long range firing distances. To better understand the problem, a brief understanding of thermal imaging is required.

Thermal imaging systems detect heat differentials between objects based on true infrared portions of the spectrum (900-1400 nm) as opposed to the near infrared portion of the spectrum. All bodies radiate energy in accordance with their temperature according to black body radiation laws. Thus objects having different temperatures can be differentiated from each other by the different thermal signatures that they provide. An IR sensing system can be employed to detect differential heat signatures and then provide a color-mapped image to a viewer.

A metal target of the type used in long range training will have a heat signature that is substantially similar to the signature of the background. This makes the standard metal target virtually indistinguishable by thermal imaging techniques. To address this problem, a number of techniques have been employed to imbue metal targets with a heat signature that can differentiate them from the background.

One technique makes use of chemical heating packs normally used by soldiers to heat meals. These chemical packs are placed on the metal target and then activated. The target is heated by a chemical reaction in the packs, and is then hung on the A-frame. The marksmen then proceed to the desired distance and attempt to fire at the target. This solution is far from ideal. Each of the packs can produce only a fixed amount of heat, and the high heat capacity of the target requires the use of a large number of heating packs. Furthermore, the specific heat capacity and high heat conductance of the metal target results in a heating and cooling curve that is not suited for long range training, since the time it takes for the shooter to set up the target and then proceed to the firing location significantly reduces the available training time.

Other attempts at heating the target have been made by hanging the target from the A-frame and then applying a stronger heat source, such as a blowtorch, to the target. This heats the target to a higher temperature and allows a longer lasting heat signature. However, the high heat from the torch can accelerate metal fatigue and significantly weaken the metal, thereby increasing the damage to the target upon impact and decreasing the lifespan of the target.

It is therefore desirable to provide a durable target that can be provided with a heat signature to allow for use with training of thermal targeting systems. U.S. Pat. No. 4,240,212 discloses a technique for simulating the thermal appearance of objects. Electrical energy is applied to a conductive material that is mechanically attached (staples, nails, screws) to a mounting surface shaped in the form of the selected target object. The conductive material is placed to simulate the radiation pattern that the object has been shown to demonstrate. The target object is not a reusable target and is penetrated by the fired ammunition. The target is also not a reactive target and the attachment of the heating structure would not withstand the repeated severe vibration which occurs in reactive targets.

U.S. Pat. No. 4,253,670 discloses thermal targets for use in night vision target training including a frame constructed of plywood having internal cavities forming a flue draft feeding to outside vents and a heat generating structure positioned in the bottom of the frame. Clearly, this target is neither reactive nor reusable, since penetrated by fired rounds and unable to withstand repeated severe vibration.

U.S. Pat. No. 4,260,160 discloses a target for night-time gunnery including a thin, supple fabric supported on a rigid frame with a front protective sheet, which is transparent to infra-red radiation and a rear radiation-absorbing sheet of low heat capacity. An infra-red radiator heats the heat-absorbing sheet which, when warmer than its surroundings, will radiate as a black body. This structure cannot be used as a reusable long range target.

U.S. Pat. No. 4,279,599 discloses an etched metal plate used to simulate an infrared target for trainees using sited weapons. Selectively etching the plate in a variety of fashions successfully imitates the thermal signature of the simulated target. The target is intended for use in simulated target exercises and is not for use with live rounds. Only simulated weapons are "fired" at the plate, which may be electrically heated by attaching a heater to a rear surface of the plate. Clearly, this target is not constructed for use with live ammunitions, nor is it constructed to withstand live round impact and the associated vibrations.

As is apparent, targets with localized heat sources are known, even those wherein the heat source is mounted onto the target by sandwiching it between layers of the target or by inserting it into a pocket on the target. However, none of the above discussed prior art teach any reusable long range firearm training targets. Moreover, attempts to attach secondary systems or structures to known long range reactive targets (acoustic targets) in the manner described in the art have been frustrated by the severe vibration stress to which such targets are subjected.

The percussive force of a long range firearm round is jarring and can dislodge or damage an associated structure used to heat the target. Due to the high velocity of long range rounds, the metal targets used are subjected to significant momentary deformation upon impact which generates severe vibrations in the target. These vibrations are so severe that they often lead to damage of bolted or welded connections on the target, for example for the connection to the target suspension structure. In long range targets, cracking and failure of bolts and welds are commonly observed after even a short period of use, due to this severe vibrations stress.

Long range targets, although constructed to withstand impact without penetration are often also permanently deformed, especially when used at the close end of the target range. Such permanent deformations place additional strain on the target already stressed by the repeated vibration load and accelerate target disintegration. Thus, using laminated structures and/or specialized pockets directly attached to the target for mounting a heating system to a long range percussive target are undesirable, since they will not be able to reliably withstand repeated use of the target.

Therefore, it is particularly desirable to provide a long range percussive target which is heatable and sufficiently durable to withstand the vibration stress during repeated use.

SUMMARY OF THE INVENTION

One object of the present invention is to obviate or mitigate at least one disadvantage of previous targeting systems.

It is another aspect of the invention to provide a heatable long range metal target capable of providing acoustic feedback to the user on impact.

It is a further aspect of the invention to provide an acoustic feedback target which is heatable and durable to withstand the repeated vibration stress that occurs during repeated use.

The inventors have now surprisingly discovered that reliable attachment of a heating structure to a reactive target body for generating an audible feedback signal on impact by a firearm round can be achieved by using a fastening structure including vibration dampening features, such as an elastic mounting structure.

In a preferred embodiment, the invention provides a reusable long range live firearm training target, including a reactive target body for generating an audible feedback signal on impact by a firearm round, a heating element and a fastening structure connectable to the target body for mounting of the heating element to the target body. The target body has a front, impact surface and a rear surface and is constructed of hardened steel for withstanding repeated impact by high velocity rounds on the impact surface without penetration. The heating element heats a target region of the target and the fastening structure connects the heating element to the target body away from the impact surface. The fastening structure includes a vibration dampening portion for at least partially insulating the heating element from vibrations of the target body generated on impact by the firearm round.

The fastening structure is preferably connected to the rear surface of the target body. Most preferably, the fastening structure is rigidly connected to the rear surface and the vibration dampening portion is located between the target body and the heating element.

The heating element is preferably flexible for adapting in shape to deformations of the target body and is preferably an electrical heating element. The target preferably includes electrical connectors for connecting the electric heating element to a power source.

The target is preferably made of R5400 steel or HARDOX500 steel.

The vibration dampening portion of the fastening structure is preferably a duroelastic, preferably head conductive, adhesive. The duroelastic adhesive is preferably applied directly onto the back surface of the target and provides both the fastening structure and the vibration damping portion.

The target may include a plurality of the heating elements, preferably electrical heating elements independently supplied with operating power to provide heating redundancy even in the event of damage to one or more of the heating elements.

In another preferred embodiment, the invention provides a long range firearm target assembly including the reusable firearm target in accordance with the invention, an A-frame target stand, a structure for suspending the target from the A-frame to allow deflection of the target upon impact of a firearm round, a power supply and electric conductors for supplying electrical power from the power supply to the heating elements.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
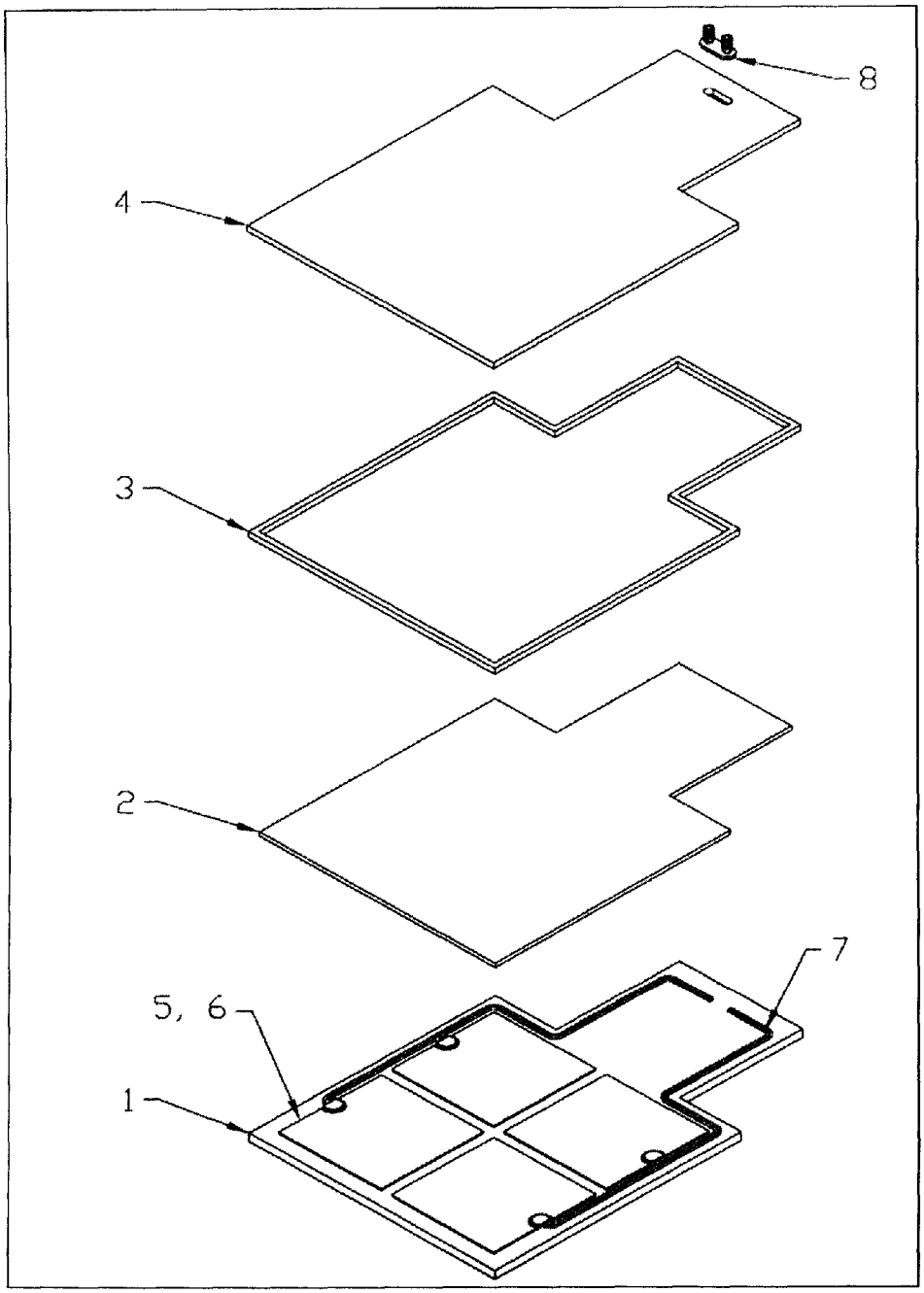
FIG. 1 is an exploded view of a preferred target in accordance with the present invention.

Generally, the present invention provides a method and system for a heatable target that provides an auditory feedback on impact and can present a thermal signature when used in conjunction with thermal imaging systems. The terms acoustic target and percussive target are used interchangeably throughout this description and are both used to define a target with a reactive target body for generating an audible feedback signal on impact by a firearm round.

As noted above, a standard military target often consists of a blank of R5400 steel. These targets are valued for their durability and robustness in a variety of environments. Their structural strength allows a great deal of abuse, and allows for repeated use as a target. A marksman will know that the target has been hit by the audible response of the target when hit by a round.

To provide such a target with a durable mechanism for generating a heat signature, one could make use of the electrical resistive nature of metal by simply applying a DC voltage across the target. The metal blank could be used as a bridge between two electrodes connected to a power source, such as a DC battery. A voltage applied across the target will generate a current which flows through the lattice nature of the metal amalgam. However, the high heat capacity and low resistance of the steel material of the target, would translate into a high current and a short battery life, rendering the target impractical for field use.

Durable attachment of an electric heating pad to the rear of the target has proven difficult, due to the severe vibration of the target upon impact, which vibration is of course required to generate the auditory feedback signaling the marksman that the target has been hit. Pockets bolted or welded to the back of the target are subject to damage through cracking and failure of the bolts or welds after only a short period of use, as discussed above. Furthermore, the severe vibration of the target can cause damage to any heating element housed loosely in such a pocket. Rigid adhesive connection of the heating pad to the rear of the target is also not acceptable, since the severe vibrations of the target quickly lead to failure of the adhesive connection.

It has now been surprisingly discovered by the inventors of the present application that a more reliable attachment of a heating pad to the target is made possible by using a fastening structure which includes vibration dampening capabilities. Preferred structures are those which are rigidly mounted to the target, but include a vibration dampening portion or element placed between the target body and the heating element to shield the heating element as much as possible from the strong vibrations of the target body. Of course, fastening structures which are in and of themselves sufficiently flexible to provide the vibration dampening effect can also be used. In one preferred embodiment, which is particularly elegant due to its inherent simplicity, an elastic fastening material is used for adhesive connection of the pad directly to the rear of the target body. Without having tested this theory and without intending to limit the invention to this effect it is presumed that the elastic nature of the fastening material provides at least some dampening of the vibrations upon impact and thereby lengthens the service life of both the heating pad and its connection to the target.

Figure 2:
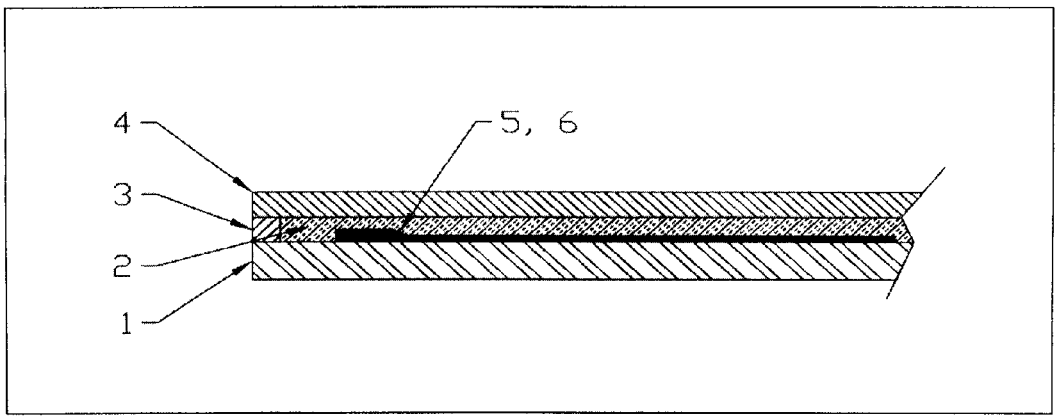
FIG. 2 is a sectional view of the target of FIG. 1.

Referring now to FIGS. 1 and 2, one embodiment of the target in accordance with the invention includes a target body 1 fabricated from armor plate steel (AR Hardox R600, R500, or similar) and having a front, impact surface 9 and a rear surface 10. The target body 1 is a 12 inch square armor plate with a 6 inch square head and a thickness of ⅜". The completed assembly is 1" thick when welded together, with the exception of the insulated terminal block. The spacer (3) is ½" smaller around the entire perimeter and ⅜" thick. It is welded on both the inside and the outside to reduce edge damage. The material is cold rolled steel. There is a cutout to accommodate the lead wires of the heating elements 5. Thicker plates can be employed for use in target practice with .50 caliber firearms. One or more heating elements 5, in the illustrated embodiment four heating elements, are fastened to the rear surface of the target body 1 by a duro-elastic fastening material 6.

Preferred fastening materials are liquids or gels which are settable to allow at least a partial embedding of the heating pad. Fastening materials which retain a high degree of elasticity after full curing are particularly preferred. Exemplary materials are commercially available silicone rubber or butyl rubber compounds. Preferred adhesive fastening materials are those which remain not only flexible, but elastic after curing, to maintain the thermal and mechanical connection to the target body 1 even if the latter is deformed, for example by projectile impact. For maximum efficiency of the heating arrangement and to minimize the heating up period, the elastic fastening material preferably has a high heat conductance.

Adhesives used to date include commercially available high heat resistant silicone caulking, 3M #467 MP, acrylic adhesive covered at the rear with a self adhering insulating sheet made of silicone foam. The latter was found to be able to withstand the heat emitted from the welding process. The most preferred fastening material is silicone rubber, for example RTV 116™ or RTV 106™ (GE Silicones, Waterford, N.Y.). Both these adhesives are able to withstand operating temperatures of up to 5000° F.

The heating elements 5 are preferably in the form of commercially available electric heating pads, such as wire mesh or carbon fiber based resistive heating pads. The heating pads preferably are selected for longevity and durability under the harsh conditions to which they are subjected during target practice. Most preferred are heating pads which are flexible and insensitive to localized damage such as deformation, pinching or even perforation.

Electric heating elements of the silicone pad type are preferred. Exemplary pads used in targets in accordance with the invention were Electro-Flex Heat Inc., #SH-2x6-12A.

Heating pads operated by DC voltage are preferred, since the manual transport of a DC battery over rugged terrain is much easier compared to an AC generator. Although DC to AC converters could be employed to run an AC operated heating pad from a DC battery, they generally use up valuable battery power and may even generate a heat signature which distracts from or is even confused with that of the target. Mistaken identification of the heated up power supply as the target is highly undesirable, since the shooter may mistakenly fire on the power supply, which will likely lead to complete destruction of the power supply upon impact by the high velocity round.

In order to protect the heating elements 5 from damage during transport and handling of the target, the heating elements are preferably fully enclosed by the fastening structure, in this case embedded in the elastic fastening material or the fastening structure includes a backing sheet 4 affixed to the target body 1 for covering the heating element. Of course, the heating element can also be both embedded in an elastic material and covered by a backing sheet. In order to avoid compression or damage to the heating elements 5, a spacer 3 is preferably placed between the target body 1 and the backing sheet 4. The spacer 4 in the illustrated embodiment is a cold rolled steel spacer welded to the target body 1. The backing sheet 4 is a steel sheet welded onto the spacer 3.

Although metal backing sheets 4 are preferred, backing sheets of other materials, such as plastic or manufactured wood composites can also be used which are either mechanically or adhesively affixed to the target body 1. Moreover, a mechanical connection between the backing sheet 4 and the target body can be achieved, for example, by crimping the edge of the target body 1 to create a peripheral retaining groove (not shown) into which the backing sheet can be inserted, or by crimping edge portions of the backing sheet to grip around the target body 1.

Heat losses from the heating elements 5 to the backing sheet 4 prolong the time required for heating up of the target and reduce the amount of time the target remains heated after deactivation of the heating elements 5. Those heat losses are preferably minimized by sandwiching a sheet of thermal insulation 2 between the heating pads 5 and the backing sheet 4. The thermal insulation 2 is preferably held in place between the heating elements and the rear plate by compressive forces and friction, but can also be mechanically affixed or adhesively secured to the heating pads 5, the rear surface 10 of the target body 1, or the backing sheet 4. Any commercially available thermal insulation materials, preferably those in sheet form, can be used as the thermal insulation 2. Preferably, materials are used which do not disintegrate upon repeated exposure to vibration stress, for example a standard silicone foam insulation. The wiring for the heating elements is preferably insulated with a high temperature TEFLON or glass cloth material 7, able to withstand the temperatures of the welding assembly operation. The wires from each heating element 5 are routed around the periphery of the target to be located the farthest from the intended projectile impact zones (target center), thus minimizing damage due to projectile impact. The wiring is then directed and attached to an electrical connector 8 mounted to the backing plate 4. The power supply cables are preferably protected, such as a flexible BX or Type AC armored cable, to protect the cable from bullet fragments. Such cables are commercially available.

When a portable power supply, such as a battery is employed, it may be preferable to provide thermal shielding to the power supply and the connectors so that their thermal signature is not detected. By properly shielding the power supply and the leads to the blank, the target can be actively heated to maintain a thermal signature. This allows the target to be setup on a frame and connected to a power supply, and then left in an active state while the shooter retreats the desired distance.

The battery capacity is preferably chosen to allow several heat/cool cycles of the target on the same battery charge. Any type of battery or other means of storing electrical energy can be used, but rechargeable batteries, such as vehicle batteries can be chosen. Rechargeable and reusable Lithium batteries are most preferred and are commercially available in various sizes, weights, voltages and capacities.

The powered heating element will continue to generate heat until the battery is disconnected, it is prompted to disconnect by the remote control device discussed below, or the circuit is otherwise broken.

Targets can be modified by providing several connector locations on the target for convenient attachment to a battery.

By locating multiple heating element 5 behind the target body 1, as described above, the option of creating targets with differently sized thermal signatures can be provided, if the heating pads 5 are separately controllable. This allows targets to be heated so that their thermal signatures resemble different real-world targets. Power to the active heating system is preferably remotely controlled, allowing a marksman to setup a target, connect it to a power supply and then proceed to the shooting location. From this location, a wireless remote control can be used to activate a target's heating system If a plurality of targets is deployed, the remote control can be setup so that a single controller can activate a plurality of targets on an individual basis. This allows a series of targets to be setup, and then activated from a distance. When target practice is completed, the targets can be deactivated at a distance as well. If an unaware individual is to intrude on the target range, the targets can be remotely powered down to reduce the likelihood of injury from either a heated target or from an electrified plate.

Fastening structures which are detachably connectable to the target body are also contemplated by the present invention. Such fastening structures are particularly useful for retro-fit applications of existing reactive long range targets. Furthermore, pocket type fastening structures attachable to the back surface of the target body can also be used, as long as the heating element is supported in the pocket by a dampening structure which at least partially shields the heating element from the vibrations of the target upon impact.

Simplified heated targets in which the fastening structure, dampening portion and heating element are all incorporated into a single element are also contemplated. For example, the heating element can be a simple parallel array, mesh or netting of heating wires embedded into an adhesive elastic compound cast directly onto the back surface of the target. The elastic compound in that embodiment functions at the same time as the fastening structure and as the vibration dampening portion and may even provide part of the heating element, namely the electrical insulation about the individual heating wires. In another simplified heated target structure, an integrated heating element and fastening structure can be formed by admixing a settable duro-elastic adhesive material with sufficient electrically conductive material, for example carbon dust or fibres, to support an electrical current through the material when set, and casting the material directly onto the back surface of the target or onto a rigid or flexible carrier structure fastenable to the back of the target.

Figure 5:
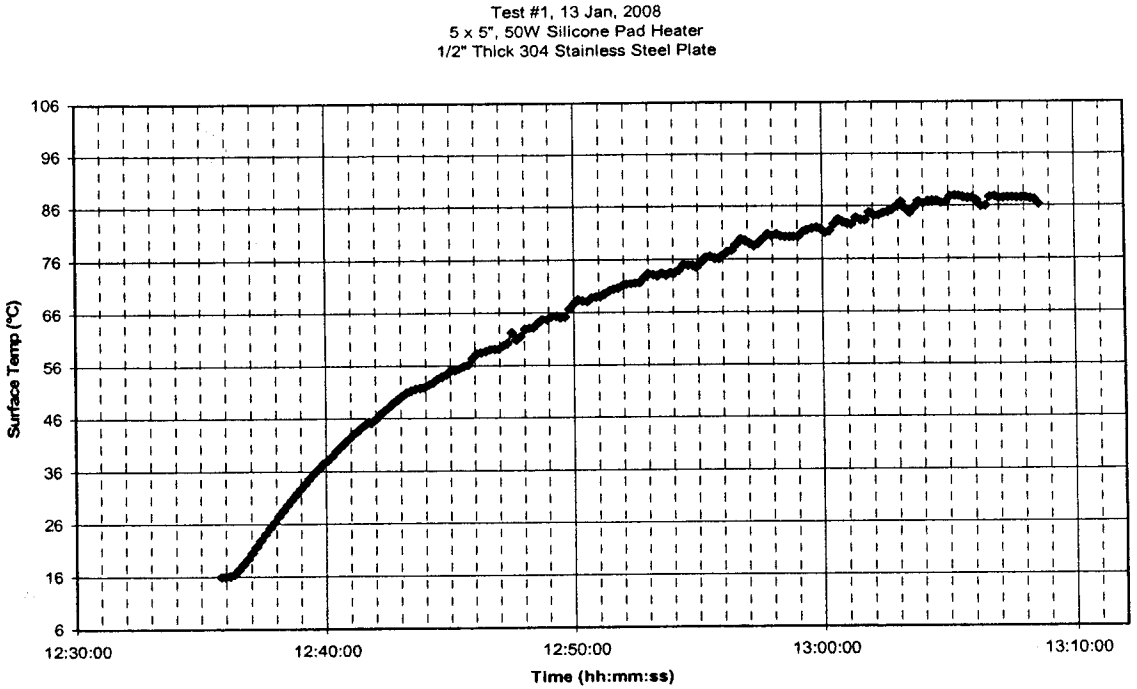
FIG. 5 shows the temperature curve of the front surface of a target in accordance with the invention.

The temperature reached by the target depends on the elapsed time since connection of the heating elements 5 to a power source if the heating elements are operated at maximum capacity. FIG. 5 illustrates the temperature of a 0.5 inches thick stainless steel plate when heated by a 5×5 inches Silicone Pad Heater with a power output of 50 W. The temperature of the heating elements 5 and the target can also be influenced by controlling the voltage to and/or current through the heating elements 5. This can be achieved by simply adding a resistive load into the heating pad circuit, or by operating the heating elements with pulse width controlled DC power generated by an electronic power supply. Feedback of a signal representative of the target temperature to the electronic power supply, for example by way of a thermocouple or by detecting the relative decrease in the heating pad resistance can be used to maintain the temperature of the target at a selected temperature above ambient, for example 10 degrees C. higher than ambient. This ensures that the target will always provide a reliable thermal signal to the shooter. One method of maintaining the temperature of the target at a certain temperature is by way of time based heating, where the heating elements 5 are automatically de-activated after they reach a certain temperature and then automatically re-activated when they cool down to a temperature where the components inside the battery box detects that more heating is required in order to maintain the target temperature at a operable level.

Another method of maintaining the temperature of the target is by means of integrating a two-way feedback system from the target to the remote. This allows the user to set the desired temperature remotely.

In a preferred embodiment, the target is constructed to allow the selection of two or more operating temperatures by the user, for example, a constant 37° C. (body temperature), or a constant 70° C. (vehicle temperature). The user can then select any of the preset operating temperatures for the target either at the power supply or through the remote. This provides improved training variability.

Figure 6:
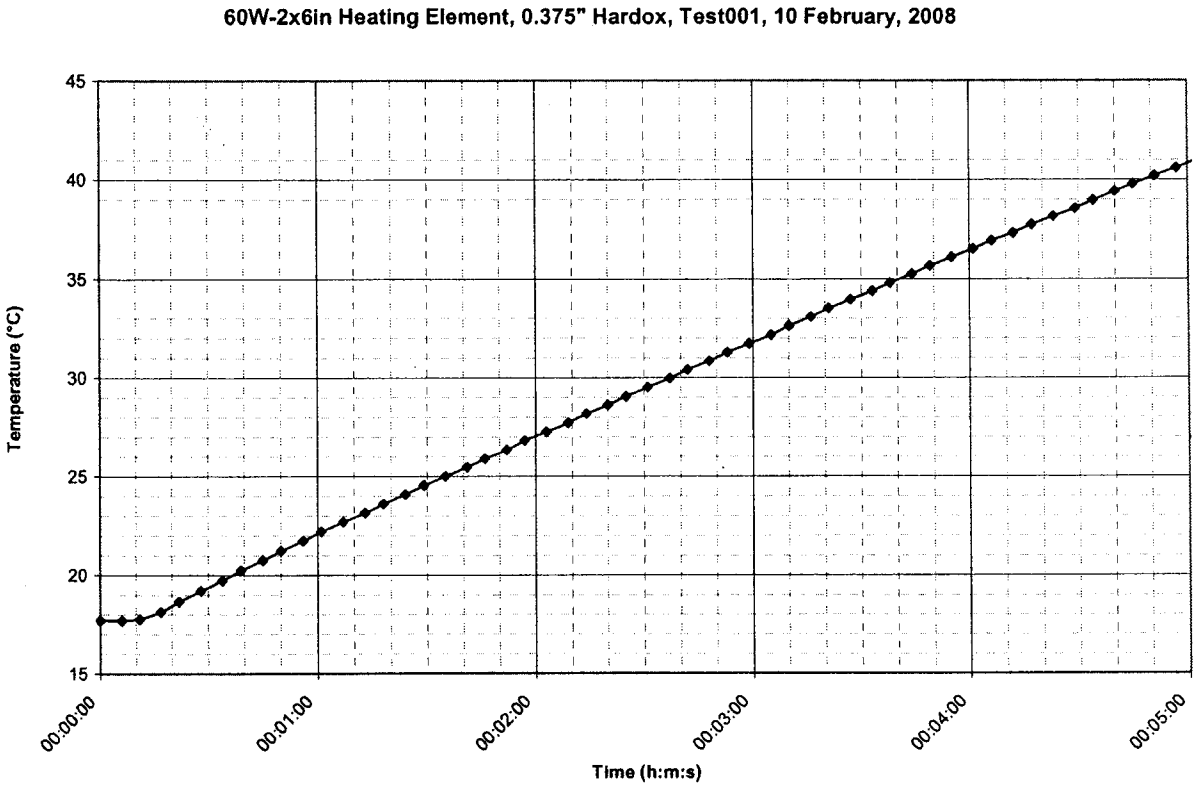
FIG. 6 shows the temperature curve achieved with a single heating element attached to a sample piece of ⅜" thick Hardox.

The temperature reached by the target is dependant on the mass and specific heat of the target, the power applied, and the length of time the power is applied. The mass and specific heat of the target remain constant, therefore, the temperature reached can be controlled by the power applied to the target (through the heating elements), or by the duration of the heating cycle. A test was conducted with a single heating element attached to a sample piece of ⅜" thick Hardox 500, with a temperature sensor attached to the center of the Hardox 500 sample, on the opposite side to the heating element. Full power was applied to the heating element (6×2" at 5 W/in2=60 W total), while the temperature was measured and logged. The graph in FIG. 6 illustrates the temperature rise over time. The temperature rise was observed to be approximately 5° C./minute. A time delay was observed of approximately 15 seconds from the time power was applied to the time that a measurable temperature increase occurred at the sensor.

The target temperature will be increased above the ambient temperature by applying power for a pre-determined time interval. The power can also be regulated remotely via a two way feedback system that may be integrated into the target system. The power can also be controlled by pulse width modulation of the power applied to the heaters. In this way, a power level of 50% can be achieved by rapidly turning the power to the heating element on and off, several times per second, with equal on and off times, by means of a semiconductor device. For power levels above 50%, the on time is proportionally longer than the off time. The inverse is true for power levels below 50%.

The power level supplied to the target is controlled by a target controller, which is a microprocessor based system with wireless communication capabilities. Power for the target is supplied by a rechargeable battery pack or, alternatively, by commercially available batteries. A target heating cycle is initiated by a command from a wireless remote control device. The microprocessor receives the command, starts the heating cycle, and sends a confirmation message back to the remote controller that the heating cycle has started. At the end of a preset time period, the heating cycle is stopped automatically. This is to prolong battery life.

The target controller has a potentiometer which sends a variable voltage level to the microprocessor circuit to select a power level from 0 to 100%. The variable voltage level is converted from an analog voltage to a digital signal, which the microprocessor uses to set the pulse width modulation duty cycle (on/off ratio) to control how much power is sent to the heating elements.

A selector switch on the Target controller PCB (Printed Circuit Board) allows the remote control device to set the unit number of the target in order to allow multiple target control from one remote controller. The command from the remote control device generates information relating to which target is being controlled at any one time. This process ensures that the commands received for non-engaged targets are ignored.

The temperature of the heating elements 5 is preferably controlled remotely by way of a remote control which will be discussed in more detail below. To avoid damage to the heating pad circuit, including the heating pads, the feedback signal is preferably used to trigger automatic shut-off of the heating circuit when an unsafe operating temperature is reached. The temperature of the pads can be very exactly controlled, potentially as finely as 100,000th of a degree, to allow use of the target for R&D, for example, to measure the potential of thermal scopes in a scientific environment.

Though the power supplies have been illustrated as batteries in the discussion and figures, it should be noted that the power supply can be any of a number of elements. A generator providing either AC or DC power can be used as an element of a power supply, as could recharging systems including generators, solar arrays and other elements that would be well understood to those skilled in the art.

Figure 4:
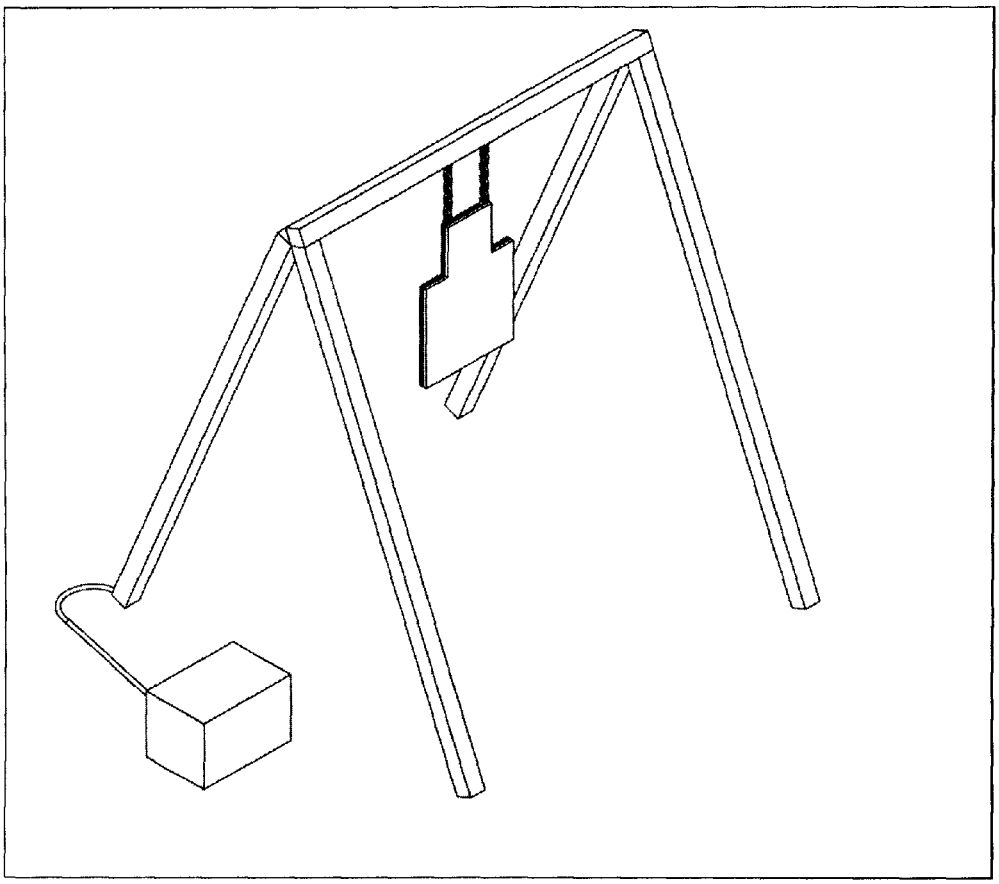
FIG. 4 is a perspective view of a target in accordance with the invention suspended for use in long range target practice.

During use, the target is suspended from an A-frame 12 as shown in FIG. 4. Chains 14 or belted rubber straps (not shown), are used to suspend the target from a cross beam 15 of the A-frame 12. The target is connected to the power supply 16 by wiring 17. The power supply 16 is preferably positioned at a sufficient distance to avoid impact by stray rounds. However, this may require long lead wires 17.

The target is constructed to withstand impact by high velocity rounds without penetration. Thus, the location best protected from any rounds fired at the target would be behind the target itself That means the power supply would also be best protected when located behind the target. In another preferred embodiment the power supply 16, in this case in the form of a rechargeable battery, is suspended from a rear support extension arm 20 of the A-frame 12. The power supply 16 is located directly behind the target and suspended to allow movement of the power supply in conjunction with vibrations of the A-frame 12 and swinging movements of the target. Of course, this also reduces the amount of wiring required. In this embodiment, a further means of protecting the power source 16 is by shielding it from ballistic impact by covering the interior of the power supply box with ballistic protection material (i.e. certain types of rubber or insulation).

In order to reduce the amount of reciprocating swinging motion of the target upon repeated impacts, the A-frame structure 12 includes a stabilizing stem. The front of the stabilizing stem is preferably covered with a material that shields the power supply 16 from the impact of a swinging motion (i.e. rubber).

The target preferably includes a GPS locator (MGRS software-Canada and Lat-long-software-U.S. and global) to facilitate recovery of targets, as well as increase the accuracy of training scenarios, especially when targets are well hidden on the shooting range. The GPS locator would preferably be integrated into the remote system so that the location information of the target is transmitted wireless to the remote for display on the LCD display so that the user is able to detect the location of the target in a precise manner.

The target furthermore preferably includes a detection arrangement for determination of the location of a hit. Most preferably, the hit location information is transmitted wireless to the remote control for display on the LCD display of the remote. This detection arrangement can also be used to track the total number of hits on the target, for quality control purposes.

In an alternative embodiment, the target can include both heating pads as described above and cooling pads for cooling down a heated target to quickly bring it back to ambient temperature. The cooling pads preferably are selected for longevity and durability under the harsh conditions to which they are subjected during target practice. Most preferred are cooling pads which are flexible and insensitive to localized damage such as deformation, pinching or even perforation. Electric cooling elements of the piezo-electric type are preferred, which cool down when subjected to an electric current. Other methods of cooling the target may also be used, for example, a Freon based cooling system.

EXAMPLE I

Target Body

A target body made of ⅜" (0.0095 m) thick armor plate HARDOX 500 steel was used. The target front plate consisted of a 12" (0.3048 m) square body with a 6" (0.1524 m) square head, cut from a single piece.

The power required to heat a mass of material is expressed by:

$$P = \frac{M * Cp * \Delta T}{t}$$

wherein P=Power (W); M=Mass (kg); Cp=Specific heat capacity (J/kg° C.); T=Required temperature change (° C.); t=required heating time in seconds (s); (note: 1 W=1J/s)

The density of HARDOX500 is 7850 kg/m$^3$.

The mass of the target front is calculated as volume×density.

$$M=(Vb+Vh)*\rho$$

wherein Vb=Volume of Body; Vh=Volume of Head; ρ=Density (kg/ m$^3$).

Vb=0.3048 m*0.3048 m*0.0095 m=0.000883 m$^3$

Vh=0.1524 m*0.1524 m*0.0095 m=0.000221m$^3$

∴M=(0.000883 m$^3$+0.000221 m$^3$)*7850 kg/m$^3$=8.67 kg

The specific heat capacity (Cp) of Hardox500 is 470 J/kg° C. Thus, the power required for a temperature rise of 10° C. in 5 minutes (300 s) is:

$$P = \frac{8.67\ \text{kg} * 470\ \text{J/kg} * 10°\ \text{C.}}{300\ \text{s}} = 136\ \text{W}$$

In order to achieve a satisfactory heating up speed, four 50 W silicon pad electric heating elements 5 (Electro-Flex Heat Inc., #SH-2x6-12A) were fastened to the target.

Thermal conductivity and thermal resistance describe heat transfer within a material once heat has entered the material. Because real surfaces are never truly flat or smooth, the contact plane between a surface and a material can also produce a resistance to the flow of heat. Air filled voids between the contact planes resist the flow of heat and force more of the heat to flow through the contact points. This constriction resistance is referred to as surface contact resistance and can be a factor at all contacting surfaces. Thus, it is preferred to use fastening materials which allow the heating pads to be pushed into the soft material prior to setting to eliminate air bubbles under the heating pads. Moreover, it is preferred to use a thermally conductive fastening material or adhesive in order to improve the flow of heat to the target body 1 of the target. In this embodiment, a silicone based adhesive was used as the fastening material, namely RTV 116™ of GE Silicone, which set to a duro-elastic layer connecting the heating pads 5 to the rear of the target. Thermal insulation 2 between the heating elements 5 and the backing plate 4 reduces the flow of heat away from the impact surface 9 of the target body 1.

Heat flow through a material is expressed by Fourier's equation:

$$Q = \lambda * A * \frac{\Delta T}{d}$$

where: Q=Rate of Heat Flow (W); λ=Thermal Conductivity (W/m° C.); A=Contact Area (m$^2$); ΔT=Temperature Difference (° C.); and d=Distance of Heat Flow (m); λ=45 (W/m° C.) for Hardox500.

EXAMPLE II

Remote Control Fabrication

Figure 3:
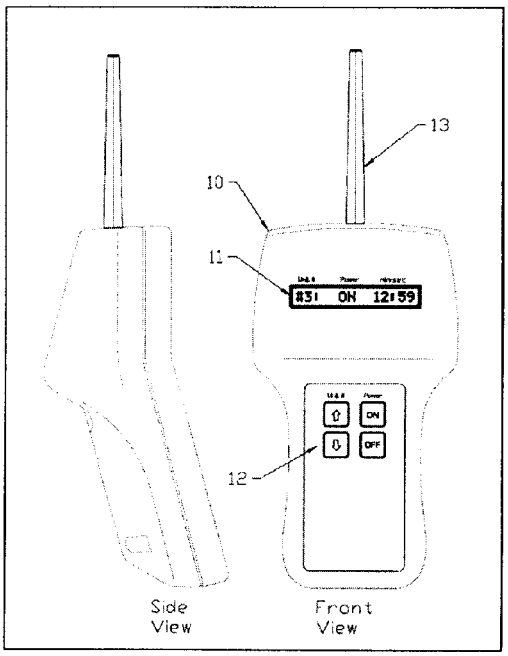
FIG. 3 is a front and side view of a preferred remote control for use with a target in accordance with the invention.

The remote control is fabricated from the elements referenced in FIG. 3. A commercially available hand-held, environmentally sealed enclosure 10 houses an alpha-numeric display 11, LCM-S01601DSF, a preferably illuminated keypad 12 which is a Part of the PCB, Radiotronix # ANT-915-06A (½ wave dipole RPSMA connector), and an antenna 13, Radiotronix # ANT-915-06A (½ wave dipole RPSMA connector). The remote control is operated by way of a microprocessor based custom control board (PCB), PCB Assembly drawing (Preliminary) attached, and a wireless communications module Radiotronix #Wi.232FHSS-250-FCC-ST-R. Power to the remote control is provided by a rechargeable Li-Ion battery pack (Rose+Bopla, Beluga Ex Series) or, alternatively, the remote control may also include a disposable battery power source, commercially available from Rose+Bopla (BOS Streamline Series). The batteries can be replaceable or rechargeable. The rechargeable batteries are commercially available Li-Ion cells. The replaceable batteries can be simple AA cell batteries or the battery pack can be modified to use alternative battery types. The rechargeable batteries are preferably charged under the control of the microprocessor in the remote. The microprocessor monitors the battery voltage during the charging cycle and controls the charging current based on the measured battery voltage. This is a well known process. The battery charging current can be supplied from a wall adapter.

The remote control unit consists of a microprocessor based circuit with a wireless modem (communication device), alpha-numeric display, keypad, and battery pack.

Two keys on the remote control unit allow the operator to increment or decrement the unit number to be controlled. Two additional keys allow the operator to turn the selected target on or off. In an alternative embodiment, additional touch pad keys would be incorporated into the remote control in order to account for additional functions, some of which are explained above. The alpha numeric display allows the operator to view which thermal target is being controlled at any given time. A timer is maintained for each target and displayed to indicate the amount of time that the selected target is on. The target may be automatically turned off after a predetermined period, after several temperature cycling cycles (turn off time would occur preferably after 1 hour, but any other time can be chosen), or can be turned off manually before the time-out period.

When a selected target is turned on with the remote control unit, a digital signal is sent via the wireless modem. The digital signal display includes the target number, and the commanded state (on or off). The remote control unit then waits for a reply signal from the selected target to confirm that the command has been received and executed. If the confirming reply is not received within 250 ms (0.25 seconds), the command is resent. This command will repeat up to 10 times if required. If no reply is received after 10 attempts, the time display on the remote will display "ERR" to indicate that there has been a communication error. This could be caused by any of the following:

i. The selected target is out of range.

ii. The selected target is not turned on.

iii. The battery in the selected target is dead.

iv. The selected target controller is damaged.

Preferably, the remote also includes a battery charge indicator for the power supply of the target, whereby the relevant data on the charge level of the target's power supply are detected continuously or at regular intervals directly at the power supply and transmitted to the remote. Most preferably, the remote control includes a low charge warning indicator for both the target power supply and the battery of the remote.

Although the targets of the invention have been described above for use as stationary targets for long range firearm training, they can also be adapted for various other firearm training scenarios. For example, the targets can be directly mounted on the ground rather than in an A-frame. For shorter range applications, the target body shape would be altered (i.e an 8" by 8" square sheet of AR 500, AR 600 steel, or equivalent). In this embodiment, the target would be preferably mounted at an angle tilted away from the shooter, preferably at an angle of 30°. In that embodiment, the remote control is preferably adapted to operate the target.

The targets of the invention can also be adapted for use in existing target systems, for example, the LaRue target system. For that purpose, a mount portion in the form of a pre-cut piece of steel is connected to the bottom of each target, which mount portion will fit into the existing target systems. In the LaRue system, the targets fall over when hit and are erected back up by way of a motor. To allow for the up and down movement of the target, the cabling between power supply and target must be adapted. Again, the preferred location of the power supply is directly behind the target, preferably on the ground. A preferred embodiment would have a longer cabling system (i.e. 17 feet) in order to allow for flexibility when routing power source cable away from the LaRue mobile target system.

Although the targets of the invention have been described above for use in stationary applications, they can be used equally well as moving targets. The targets can be manufactured to represent the size of a motor vehicle (for example a compact car, a minivan, or a mid-size pick-up truck). These targets and their power supplies can then be mounted on a remotely operated scrap vehicle in a manner to both shield the operating engine from live fire and to represent the heat signature that the running engine it would emit. Such targets can then be shot at from the air or from the ground while moving along the ground. In that embodiment, the remote control is preferably adapted to operate not only the target, but also the movements of the vehicle. For additional target practice, one or more thermal targets in accordance with the invention can also be placed inside the vehicle to represent the thermal signature of persons sitting in the vehicle.

Beyond land-based shooting range operations, targets in accordance with the invention can also be adapted for maritime target practice. For example, the percussive steel layer of the target of the present invention can be manufactured in the shape of an approximately 28" by 4' drum shaped target. The drum is lined with heating pads and filled with insulating spray foam. A space is left at the centre to accommodate the battery box. Access to the drum interior is provided by a hatch, which can be tightly sealed to prevent water infiltration. The size of the drum is selected to ensure buoyancy of the target. The drum is preferably also provided with lift hooks to facilitate retrieval from the water. In that embodiment, the remote control is preferably adapted to operate and locate the target.

The target can also be included in or constructed as a remote controlled boat, wherein at least parts of the boat are covered by a target in accordance with the invention. In that embodiment, the remote control is preferably adapted to operate not only the target, but also the movements of the boat.

The above-described embodiments of the present invention are intended to be examples only. Alterations, modifications and variations may be effected to the particular embodiments by those of skill in the art without departing from the scope of the invention, which is defined solely by the claims appended hereto.

The invention claimed is:

1. A reusable long range live firearm training target, comprising a reactive target body made of a single plate of armor plate steel for generating a long range audible feedback signal on impact by a long range high velocity firearm round, the target body having a front, impact surface and a rear surface, the target body being constructed of hardened steel for withstanding repeated impact by long range high velocity rounds on the impact surface without penetration;

a heating element for heating a target region of the target body; and a fastening structure connecting the heating element to the target body away from the impact surface, the fastening structure including a vibration dampening portion for at least partially insulating the heating element from vibrations of the target body generating the audible feedback signal on impact by the firearm round, the vibration dampening portion being heat conductive for thermally coupling the heating element to the target body.

2. The target of claim 1, wherein the fastening structure is connected to the rear surface of the target body.

3. The target of claim 2, wherein the fastening structure is rigidly connected to the rear surface and the vibration dampening portion is located between the target body and the heating element.

4. The target of any one of claims 1 to 3, wherein the heating element is flexible for adapting in shape to deformations of the target body.

5. The target of claim 2, wherein the heating element is an electrical heating element.

6. The target of claim 3, wherein the target includes electrical connectors for connecting the electric heating element to a power source.

7. The target of claim 1, wherein the hardened steel is R5400 or HARDOX500 steel.

8. The target of claim 3, wherein the vibration dampening portion of the fastening structure is a settable duroelastic adhesive.

9. The target of claim 8, wherein the heating element is embedded in the adhesive prior to setting of the adhesive.

10. The target of claim 8 or 9, wherein the duroelastic adhesive is applied to the back surface of the target and provides both the fastening structure and vibration damping portion.

11. The target of claim 1, comprising a plurality of the heating elements.

12. The target of claim 11, wherein the heating elements are electrical heating elements independently supplied with operating power to provide heating redundancy even in the event of damage to one or more of the heating elements.

13. A long range firearm target assembly, comprising a reusable firearm target as defined in claim 1, an A-frame target stand;

means for suspending the target from the A-frame to allow deflection of the target upon impact of a firearm round;

a power supply; and electric conductors for supplying electrical power from the power supply to the heating elements.

* * * * *